US010786427B2

(12) United States Patent
Ci

(10) Patent No.: US 10,786,427 B2
(45) Date of Patent: Sep. 29, 2020

(54) PLATFORM FOR CONDITIONING MERIDIAN FUNCTIONS

(71) Applicant: Zhonghua Ci, Beijing (CN)

(72) Inventor: Zhonghua Ci, Beijing (CN)

( * ) Notice: Subject to any disclaimer, the term of this patent is extended or adjusted under 35 U.S.C. 154(b) by 136 days.

(21) Appl. No.: 15/993,003

(22) Filed: May 30, 2018

(65) Prior Publication Data

US 2019/0365603 A1 Dec. 5, 2019

(51) Int. Cl.
*A63B 26/00* (2006.01)
*A61H 39/00* (2006.01)

(52) U.S. Cl.
CPC ..... *A61H 39/00* (2013.01); *A63B 26/00* (2013.01); *A61H 2201/0192* (2013.01);
(Continued)

(58) Field of Classification Search
CPC .... A63B 5/00; A63B 5/08; A63B 5/11; A63B 2005/085; A63B 21/0004; A63B 21/00047; A63B 21/00058; A63B 21/00069; A63B 21/00076; A63B 21/00185; A63B 21/008; A63B 21/00083; A63B 21/0085; A63B 21/0087; A63B 21/02; A63B 21/023; A63B 21/025; A63B 21/026; A63B 21/157; A63B 21/4045; A63B 21/4027; A63B 21/04; A63B 21/0442; A63B 21/045; A63B 21/0455; A63B 21/05; A63B 21/055; A63B 21/0557; A63B 21/068; A63B 21/15; A63B 21/158; A63B 21/4047; A63B 22/16; A63B 22/18; A63B 22/185; A63B 23/035; A63B 23/03508; A63B 23/03516; A63B 23/0325; A63B 23/0405; A63B 23/03; A63B 23/205; A63B 23/0211; A63B 23/0216; A63B 23/0222; A63B 23/0227; A63B 23/04; A63B 23/0458; A63B 23/0482;
(Continued)

(56) References Cited

U.S. PATENT DOCUMENTS 4,494,662 A * 1/1985 Clymer ..... A63B 21/023 482/123
5,201,568 A * 4/1993 Christensen, Jr. ... A47C 16/025 248/394

(Continued)

*Primary Examiner* — Loan B Jimenez
*Assistant Examiner* — Andrew M Kobylarz
(74) *Attorney, Agent, or Firm* — Cantor Colburn LLP

(57) ABSTRACT

A platform for conditioning meridian functions includes a pedal and a bracket mechanism; the bracket mechanism includes: a bracket and an angle adjusting mechanism; the angle adjusting mechanism includes: a first angle adjusting mechanism and a second angle adjusting mechanism; the first angle adjusting mechanism includes: a first support rod, a first adjusting sleeve, a first gear shaft and a first adjusting groove; the second angle adjusting mechanism includes: a second support rod, a second adjusting sleeve, a second gear shaft and a second adjusting groove; the first adjusting groove and the second adjusting groove are symmetrically provided in plurality. By providing the angle adjusting mechanism, different inclination angles of the pedal can be realized, and the combined design of the angle adjusting mechanism, the support rods and the adjusting sleeves effectively improves the stability and security of a pack up angle adjusted by a support plate of the pedal.

12 Claims, 6 Drawing Sheets

(52) U.S. Cl.
CPC .. *A61H 2201/164* (2013.01); *A61H 2201/169* (2013.01); *A61H 2203/0406* (2013.01); *A61H 2205/125* (2013.01); *A63B 2225/093* (2013.01)

(58) Field of Classification Search
CPC ... A63B 23/0494; A63B 23/08; A63B 23/085; A63B 23/10; A63B 23/4041; A63B 23/4034; A63B 23/4031; A63B 23/4033; A63B 26/00; A63B 26/003; A61H 2201/0192; A61H 2201/169; A61H 2203/0406; A61H 2203/125; A61H 39/00; A47F 5/16
See application file for complete search history.

(56) References Cited

U.S. PATENT DOCUMENTS

| | | | | |
|---|---|---|---|---|
| 2002/0183662 | A1* | 12/2002 | Lu | A61H 1/005 601/28 |
| 2007/0066454 | A1* | 3/2007 | Foley | A63B 21/015 482/92 |
| 2015/0008072 | A1* | 1/2015 | Knox | B60N 2/1685 182/141 |

* cited by examiner

PLATFORM FOR CONDITIONING MERIDIAN FUNCTIONS

TECHNICAL FIELD

The present application relates to the technical field of health and fitness facilities, and particularly to a platform for conditioning meridian functions.

BACKGROUND

With improvements of people's life, more and more people are starting to pay attention to health care exercises. Theories of foot health care, meridian health care using the traditional Chinese medicine and exercise health care develop rapidly and are widely used. In the related art, there are many similar ready-made assistant facilities, however their functions are single, meanwhile, the products have shortcomings in principle application, personality, adaptability, and safety, and thus they fail to give full play to the function of conditioning meridians, and have problems such as unstable safety, inconvenient usage, insignificant conditioning, and difficulty in persistence. The technologies and products, which can better fuse the theories of foot health care, meridian health care using the traditional Chinese medicine and exercise health care, through meridian stretching exercise at a personalized appropriate angle to achieve an object of conditioning a meridian state and smoothing the body functions, are still a blank and have wide and deep space to be researched.

For the problems existing in the related art, no effective solution has been solved yet.

SUMMARY

A main object of the present application is to provide a platform for conditioning meridian functions so as to solve the problems existing in the related art.

In order to achieve the above object, with respect to one aspect of the present application, a platform for conditioning meridian functions is provided.

According to the present application, the platform for conditioning meridian functions includes:

a pedal and a bracket mechanism; the bracket mechanism includes: a bracket and an angle adjusting mechanism; the angle adjusting mechanism includes: a first angle adjusting mechanism and a second angle adjusting mechanism; the first angle adjusting mechanism includes: a first support rod, a first adjusting sleeve, a first gear shaft and a first adjusting groove; the second angle adjusting mechanism includes: a second support rod, a second adjusting sleeve, a second gear shaft and a second adjusting groove; the first adjusting groove and the second adjusting groove are symmetrically provided with a plurality of adjusting grooves;

a front end of the pedal and a front end of the bracket are hinged with each other;

the first adjusting groove is provided at one side of the first adjusting sleeve; one end of the first support rod is perpendicularly connected with the first gear shaft insertable in the first adjusting groove, the other end of the first support rod is hinged to a rear end of a left side of the bottom portion of the pedal; the one end of the first adjusting sleeve is hinged to the left side of the bottom portion of the pedal, and the other end thereof is sleeved on one end of the first support rod provided with the first gear shaft;

the second adjusting groove is provided at one side of the second adjusting sleeve; one end of the second support rod is perpendicularly connected with the second gear shaft insertable in the second adjusting groove, the other end of the second support rod is hinged to a rear end of a right side of the bottom portion of the pedal; the one end of the second adjusting sleeve is hinged to a right side of the bottom portion of the pedal, and the other end thereof is sleeved on one end of the second support rod provided with the second gear shaft.

Furthermore, for the platform for conditioning meridian functions as mentioned above, the first angle adjusting mechanism may further include: a first notch (13-1) and a first movable plate (14-1) are provided in one end of the first gear shaft (15-1) which is provided in the first support rod (9-1); the second angle adjusting mechanism (8-2) further includes: a second notch (13-2) and a second movable plate (14-2) are provided in one end of the second gear shaft (15-2) which is provided in the second support rod (9-2).

The first movable plate is slidingly provided inside the first adjusting sleeve; the first movable plate is a U-shape movable plate, one end of the first movable plate is clamped with the first notch, and the other end of the first movable plate is provided with the first gear shaft.

The second movable plate is slidingly provided inside the second adjusting sleeve; the second movable plate is a U-shape movable plate, one end of the second movable plate is clamped with the second notch, and the other end of the second movable plate is provided with the second gear shaft.

Furthermore, for the platform for conditioning meridian functions as mentioned above, the first angle adjusting mechanism may further include a first limit block slidingly provided inside the first adjusting sleeve; the second angle adjusting mechanism further includes a second limit block slidingly provided inside the second adjusting sleeve;

the first limit block is provided with a first limit groove in a convex shape, the first gear shaft is inserted in the first limit groove, when the first limit groove is provided in any adjusting groove of the first adjusting groove, the first gear shaft is meanwhile located in an upper portion of the first limit groove;

the second limit block is provided with a second limit groove in a convex shape, the second gear shaft is inserted in the second limit groove, when the second limit groove is provided in any adjusting groove of the second adjusting groove, the second gear shaft is meanwhile located in an upper portion of the second limit groove.

Furthermore, for the platform for conditioning meridian functions as mentioned above, the first angle adjusting mechanism may further include a first spring, the second angle adjusting mechanism further includes a second spring;

The first spring has one end connected to a front end of the first movable plate, and the other end connected to a lower end of the first limit block located behind the first limit groove.

The second spring has one end connected to a front end of the second movable plate, and the other end connected to a lower end of the second limit block located behind the second limit groove.

Furthermore, for the platform for conditioning meridian functions as mentioned above, the pedal may include: an upper housing, a lower housing and the support plate provided in order from top to bottom; the upper housing and the lower housing are fixedly connected therebetween through a plurality of fixing screws; the lower housing and the support plate are fixedly connected therebetween through a plurality of fixing screws.

Furthermore, for the platform for conditioning meridian functions as mentioned in the preceding, the pedal further includes: a skid-proof mat; the skid-proof mat is provided on an upper surface of the pedal; a surface of the skid-proof mat is provided with a plurality of skid-proof strips and a pedaling position indication area for indicating a user to the right pedaling position.

Furthermore, the platform for conditioning meridian functions as mentioned above which may further include a first bearing shaft, a second bearing shaft, a first rotating shaft and a second rotating shaft;

one end of the first adjusting sleeve is hinged to the left side of the bottom portion of the pedal through the first bearing shaft, and one end of the second adjusting sleeve is hinged to the right side of the bottom portion of the pedal through the second bearing shaft;

left and right sides of the front end of the bottom portion of the pedal are hinged with the front end of the bracket through the first rotating shaft and the second rotating shaft, respectively.

Furthermore, the platform for conditioning meridian functions which may further include an assistant bracket mechanism; the assistant bracket mechanism includes: a bottom frame and a handrail frame; the handrail frame includes a vertical portion vertically provided on an upper surface of a front end of the bottom frame, and a handrail portion provided on a top end of the vertical portion and extended outwards in a horizontal direction.

Furthermore, for the platform for conditioning meridian functions as mentioned above, the first adjusting groove and the second adjusting groove are symmetrically provided in five, respectively, and all adjusting grooves of the first adjusting groove communicate with each other, and all adjusting grooves of the second adjusting groove communicate with each other.

An angle between the angle adjusting mechanism and the bracket may be in a range of 9 to 41.

Furthermore, for the platform for conditioning meridian functions as mentioned above, one side of the upper housing and the lower housing may correspondingly provide with a hollow notch for hand holding.

In the embodiments of the present application, the platform for conditioning meridian functions includes the pedal and the bracket mechanism; the bracket mechanism includes: a bracket and an angle adjusting mechanism; the angle adjusting mechanism includes: a first angle adjusting mechanism and a second angle adjusting mechanism; the first angle adjusting mechanism includes: a first support rod, a first adjusting sleeve, a first gear shaft and a first adjusting groove; the second angle adjusting mechanism includes: a second support rod, a second adjusting sleeve, a second gear shaft and a second adjusting groove; the first adjusting groove and the second adjusting groove are symmetrically provided in plurality, thus, the following technical effects are achieved:

1. by providing the angle adjusting mechanism, different inclination angles of the pedal can be realized by adjusting the angle adjusting mechanism, which is convenient in use, moreover, the pedal can be freely folded and packed up, and the combined design of the angle adjusting mechanism, the support rods and the adjusting sleeves effectively improves the stability and security of a pack up angle adjusted by the support plate;

2. by symmetrically providing a plurality of pairs of gear adjusting grooves on the two adjusting sleeves of the angle adjusting mechanism, the gear shafts can be realized that provides selectively support for different angles;

3. the pedal can play a supporting and protecting role through the position of surrounding frames, thus enhancing the usage safety of the user, and serving fixing and decorative functions.

BRIEF DESCRIPTION OF THE DRAWINGS

The accompanying drawings, which constitute a part of the present application, are used to provide a further understanding of the present application, so that other features, objects and advantages of the present application become more obvious. The illustrative drawings for embodiments of the present application and the description thereof are used to explain the present application, rather than constitute an improper limitation on the present application. In these drawings.

DETAILED DESCRIPTION OF THE EMBODIMENTS

Figure 1:
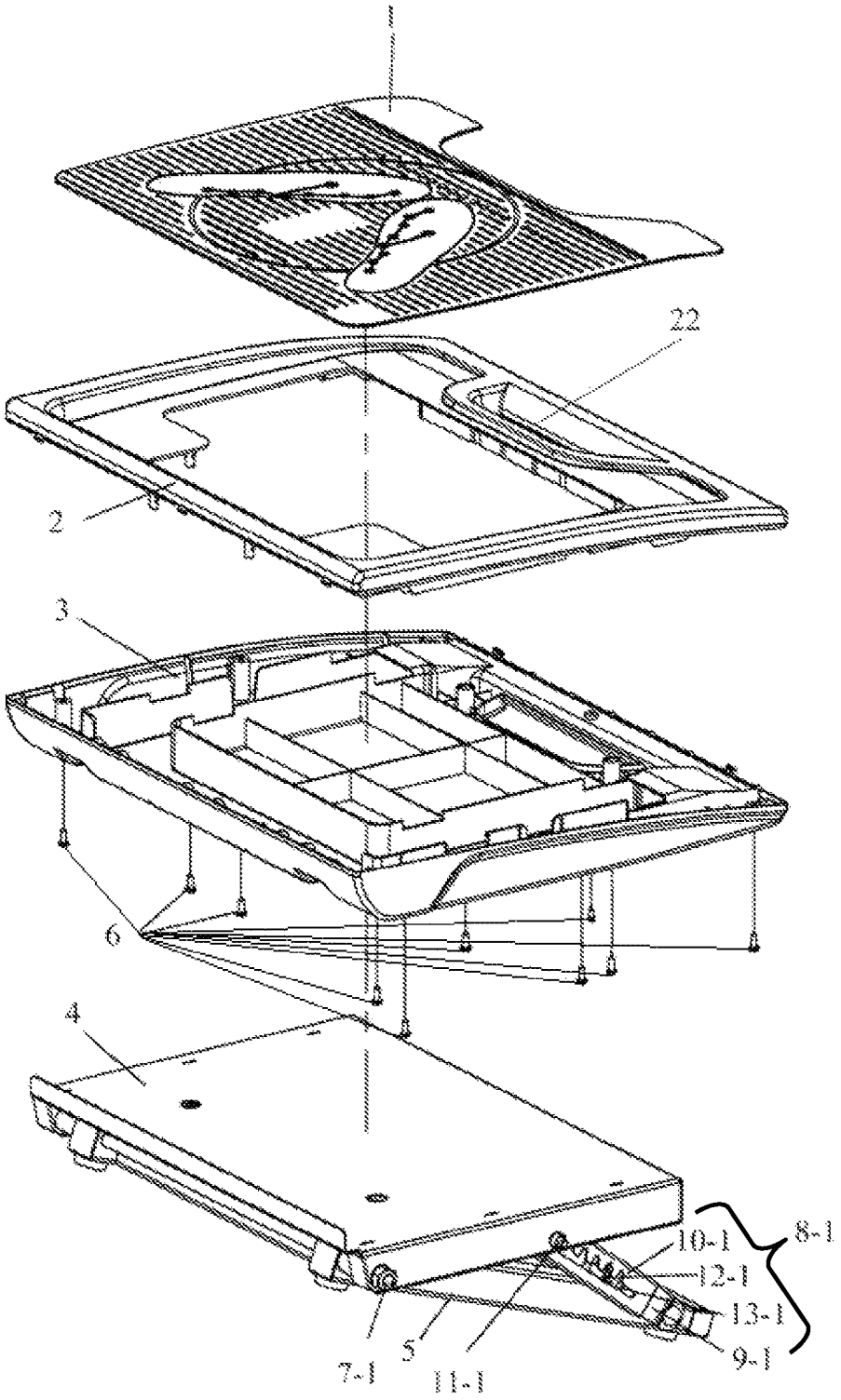
FIG. 1 is a front explosive view of an embodiment of the present application which forms an angle of view.

In order to enable a person skilled in the art to better understand solutions of the present application, the technical solutions of the embodiments of the present application will be described clearly and completely below in combination with the accompanying drawings of the embodiments of the present application. Apparently, the embodiments described are merely for some of the embodiments of the present application, rather than all of the embodiments. All the other embodiments that are obtained by a person skilled in the art without inventive effort on the basis of the embodiment of the present application shall be covered by the scope of protection of the present application.

It should be indicated that terms such as "first" and "second" in the description, the claims and the above accompanying drawings of the present application are used to distinguish similar objects, but are not necessarily used to describe a specific order or sequence. It should be understood that thus used terms can be exchanged when appropriate so as to facilitate the embodiments of the present application described herein. Besides, terms "comprising (comprise, include)" and "having" and any of their variants are intended to cover non-exclusive inclusion, for example, a process, a method, a system, a product or a device comprising a series of steps or units is not necessarily limited to clearly listing those steps or units, but may include other steps or units which are not clearly listed or inherent to the process, method, product or device.

In the present application, orientational or positional relationships indicated by terms such as "upper", "lower", "left", "right", "front", "back", "top", "bottom", "inner", "outer", "middle", "vertical", "horizontal", "transverse", and "longitudinal" are based on orientational or positional relationships as shown in the figures. These terms are mainly for better describing the present application and the embodiments thereof, rather than defining that related devices, elements or composite parts have to be in the specific orientation or configured and operated in specific orientation.

Moreover, a part of the above terms, apart from being used to represent the orientational or positional relationships, also can be used to represent other meanings, for example, the term "upper" in some cases also may be used to represent a certain type of attachment relationship or connection relationship. For a person ordinarily skilled in the art, the specific means of these terms in the present application can be understood according to specific circumstances.

Besides, terms "mount", "provide", "provided with", "connect", "join", and "sleeve" should be understood in a broad sense, for example, the connection can be a fixed connection, a detachable connection, or an integral connection; it can be a mechanical connection or an electrical connection; it can be a direct connection, or an indirect connection through an intermediate medium, or an inner communication between two devices, elements or composite parts. For a person ordinarily skilled in the art, specific meanings of the above-mentioned terms in the present application can be understood according to specific circumstances.

It should be noted that the embodiments of the present application and the features of the embodiments can be combined with each other if there is no conflict. The present application will be described in detail below with reference to the accompanying drawings and embodiments.

As shown in FIG. 1 to FIG. 4, the present application relates to a platform for conditioning meridian functions which includes a pedal and a bracket mechanism; the bracket mechanism includes: a bracket 5 and an angle adjusting mechanism 8; the angle adjusting mechanism 8 includes: a first angle adjusting mechanism 8-1 and a second angle adjusting mechanism 8-2; the first angle adjusting mechanism 8-1 includes: a first support rod 9-1, a first adjusting sleeve 10-1, a first gear shaft 15-1 and a first adjusting groove 12-1; the second angle adjusting mechanism 8-2 includes: a second support rod 9-2, a second adjusting sleeve 10-2, a second gear shaft 15-2 and a second adjusting groove 12-2; the first adjusting groove 12-1 and the second adjusting groove 12-2 symmetrically provided a plurality of adjusting grooves. Generally, in order to enable the pedal to be still capable of maintaining left-right balance when being adjusted by various angles, the first support rod 9-1, the first adjusting sleeve 10-1, the first gear shaft 15-1 and the first adjusting groove 12-1 keep consistent with the second support rod 9-2, the second adjusting sleeve 10-2, the second gear shaft 15-2 and the second adjusting groove 12-2 in shapes and they provided symmetrical with each other at two sides of the bottom portion of the pedal. Moreover, preferably, the pedal and the bracket mechanism are both provided in a rectangular shape; furthermore, the adjusting grooves of the first adjusting groove 12-1 and the second adjusting groove 12-2 are specifically provided such that, taking a direction from the angle adjusting mechanism 8 to the bracket 5 as a forward direction, each of adjusting grooves is in smooth inclined-line transition with a previous adjusting groove in the forward direction, and each of adjusting grooves is in perpendicular-line transition with a next adjusting groove in a backward direction; when the first support rod 9-1 and the first adjusting groove 12-1 are stretched, since the front and back adjusting grooves are in the inclined-line transition, the first gear shaft 15-1 can move smoothly to realize the stretching; in contrast, after a user stands on the pedal, since the front and back adjusting grooves are in the perpendicular-line transition, the first gear shaft 15-1 will be clamped at a perpendicular-line portion on the adjusting groove, and cannot be compressed, thus ensuring the security of the user standing on the pedal. The corresponding structure of the second angle adjusting mechanism 8-2 are also used the corresponding configuration.

A front end of the pedal and a front end of the bracket 5 are hinged with each other.

the first adjusting groove 12-1 is provided at one side of the first adjusting sleeve 10-1; one end of the first support rod 9-1 is perpendicularly connected with the first gear shaft 15-1 which can be inserted into the first adjusting groove 12-1, the other end of the first support rod 9-1 is hinged to a rear end of the left side of bottom portion of the pedal; the one end of the first adjusting sleeve 10-1 is hinged to the left side of bottom portion of the pedal, and the other end thereof is sleeved on one end of the first support rod 9-1 providing with the first gear shaft 15-1.

the second adjusting groove 12-2 is provided at one side of the second adjusting sleeve 10-2; one end of the second support rod 9-2 is perpendicularly connected with the second gear shaft 15-2 which can be inserted into the second adjusting groove 12-2, the other end of the second support rod 9-2 is hinged to a rear end of right side of the bottom portion of the pedal; the one end of the second adjusting sleeve 10-2 is hinged to the right side of the bottom portion of the pedal, and the other end thereof is sleeved on one end of the second support rod 9-2 providing with the second gear shaft 15-2.

In use, a user stands on the pedal directly, the length adjustment between the first support rod 9-1 and the first adjusting sleeve 10-1 as well as the length adjustment between the second support rod 9-2 and the second adjusting sleeve 10-2 can be realized by adjusting a position of the first gear shaft 15-1 in the first adjusting groove 12-1 and a position of the second gear shaft 15-2 in the second adjusting groove 12-2. Furthermore, the object of locating the pedal on planes in different angles to facilitate the usage for the user can be achieved by adjusting an opening level between a support plate 4 and the bracket 5 by adjusting the angle adjusting mechanism 8.

Figure 2:
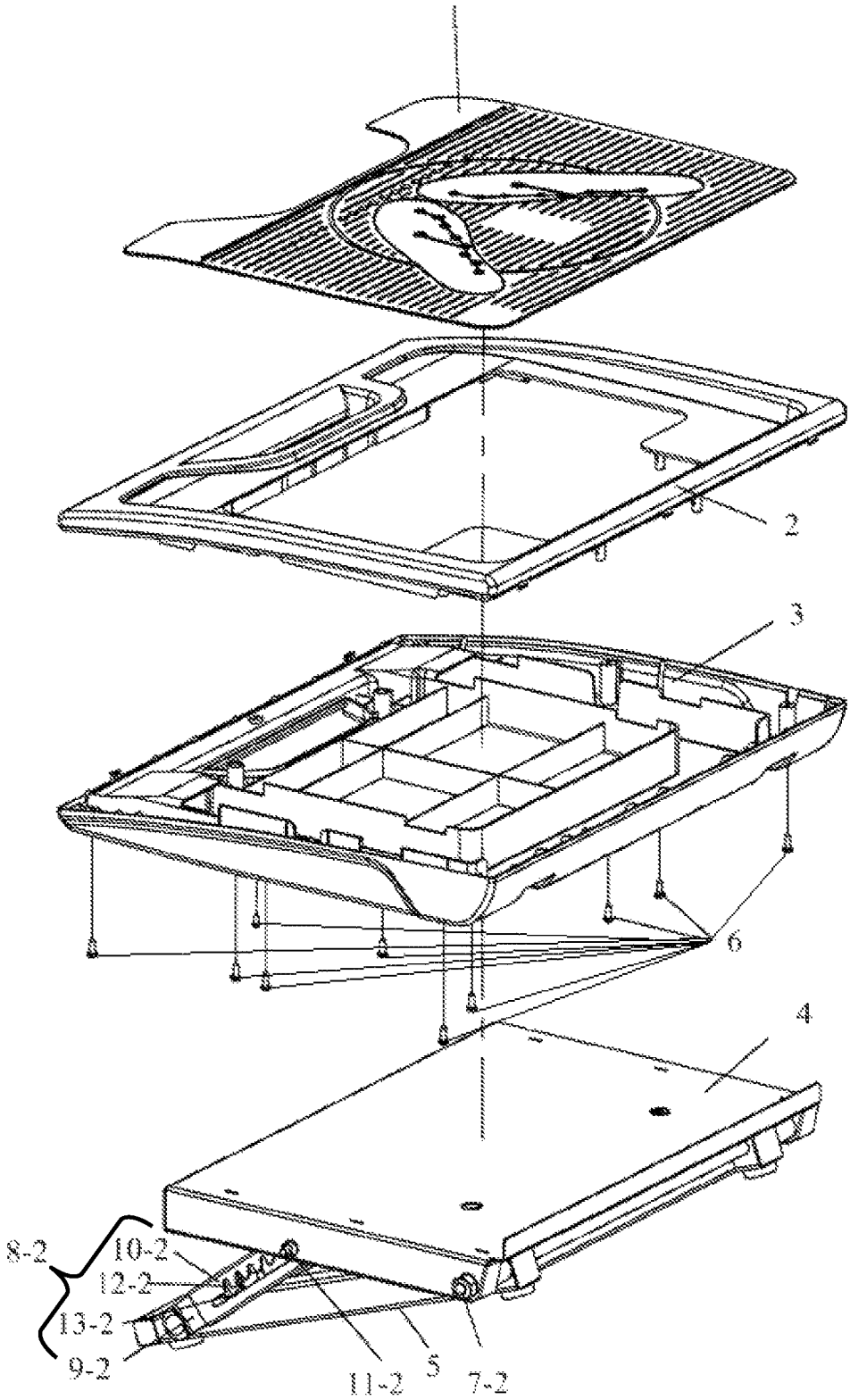
FIG. 2 is a front explosive view of an embodiment of the present application which forms another angle of view.
Figure 3:
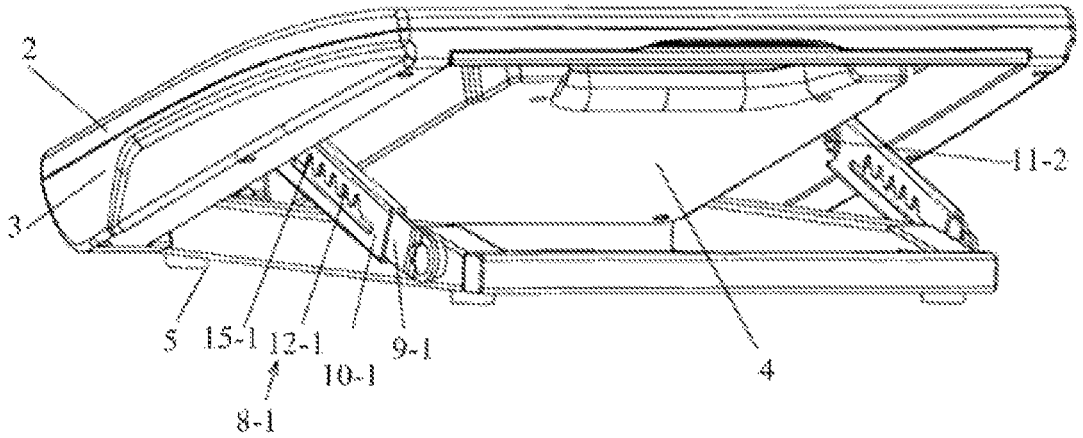
FIG. 3 is a front view of an embodiment of the present application which forms an angle of view.
Figure 4:
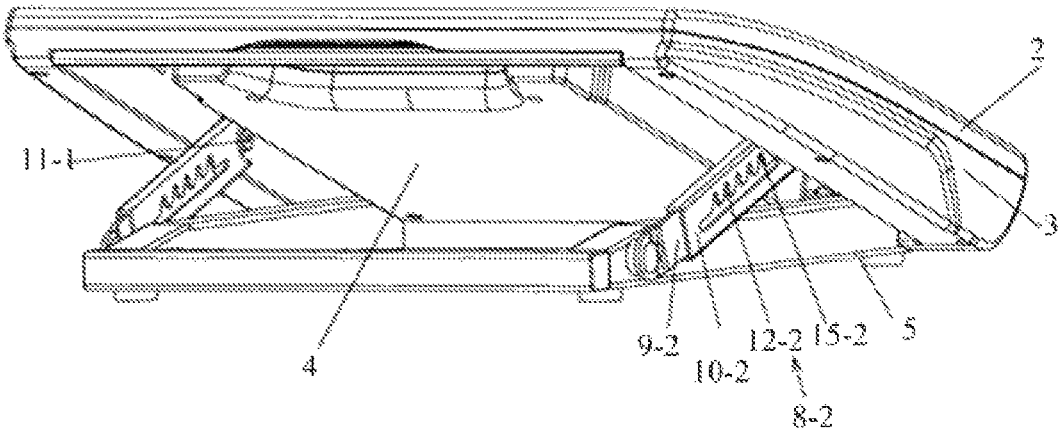
FIG. 4 is a front view of an embodiment of the present application which forms another angle of view.

As shown in FIG. 1 and FIG. 2, in some embodiments, for the platform for conditioning meridian functions as mentioned above, the first angle adjusting mechanism 8-1 further includes: a first notch 13-1 and a first movable plate 14-1 are provided in one end of the first gear shaft 15-1 which is provided in the first support rod 9-1; the second angle adjusting mechanism 8-2 further includes: a second notch 13-2 and a second movable plate 14-2 are provided in one end of the second gear shaft 15-2 which is provided in a second bearing shaft 11-2. In general, the first notch 13-1 and the first movable plate 14-1 as well as the second notch 13-2 and the second movable plate 14-2 are consistent with each other in shape and provided symmetrical with each other at two sides of the bottom portion of the pedal, respectively. Moreover, the first movable plate 14-1 and the second movable plate 14-2 are both provided in a rectangular shape, and are shape-matched with inner shapes of the first adjusting sleeve 10-1 and of the second adjusting sleeve 10-2 respectively.

The first movable plate 14-1 is slidingly provided inside the first adjusting sleeve 10-1; the first movable plate 14-1 is a U-shape movable plate, one end of the first movable plate 14-1 is clamped with the first notch 13-1, and the other end of the first movable plate 14-1 is provided with the first gear shaft 15-1.

Furthermore, the thicknesses of the first support rod 9-1 and the first movable plate 14-1 are consistent with the width of inner space of the first adjusting sleeve 10-1, therefore the first support rod 9-1 and the first movable plate 14-1 will not shift inside the first adjusting sleeve 10-1 in width direction, so as to ensure the robustness thereof.

The second movable plate 14-2 is slidingly provided inside the second adjusting sleeve 10-2; the second movable plate 14-2 is a U-shape movable plate, one end of the second movable plate 14-2 is clamped with the second notch 13-2, and the other end of the second movable plate 14-2 is provided with the second gear shaft 15-2.

Figure 7:
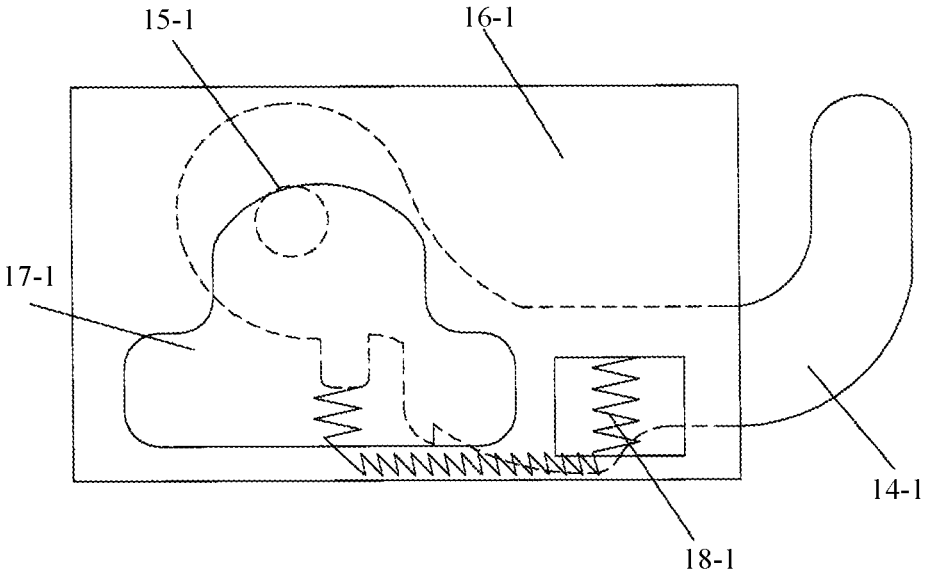
FIG. 7 is another partial of front structural view of an embodiment of the present application.
Figure 8:
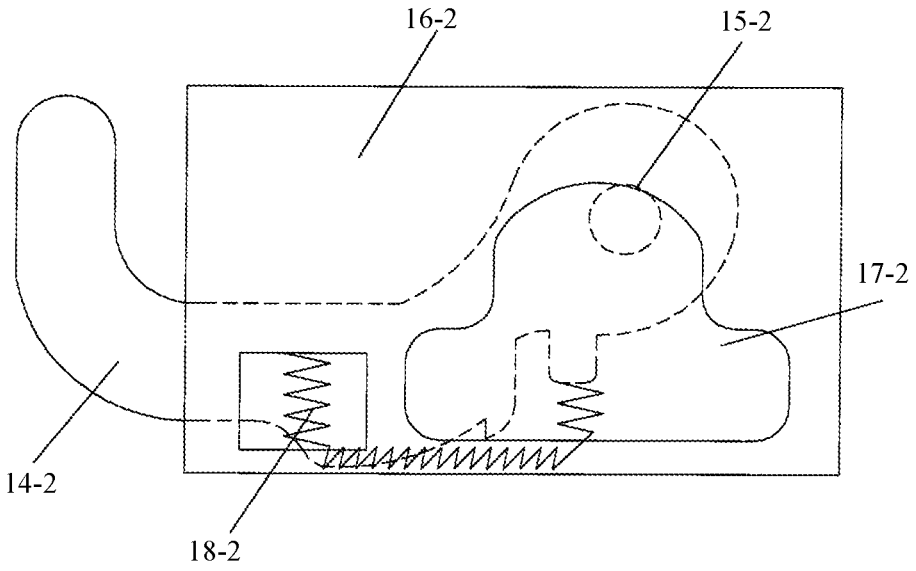
FIG. 8 is a further partial front structural view of the embodiment of the present application.

As shown in FIG. 7 and FIG. 8, in some embodiments, for the platform for conditioning meridian functions as mentioned above, the first angle adjusting mechanism 8-1 further includes a first limit block 16-1 slidingly provided inside the first adjusting sleeve 10-1; the second angle adjusting mechanism 8-2 further includes a second limit block 16-2 slidingly provided inside the second adjusting sleeve 10-2.

The first limit block 16-1 is provided with a first limit groove 17-1 in a convex shape, and the first gear shaft 15-1 is inserted in the first limit groove 17-1. As the first limit groove 17-1 is provided in any one of the adjusting grooves of the first adjusting groove 12-1, meanwhile the first gear shaft 15-1 is located in an upper portion of the first limit groove 17-1.

The second limit block 16-2 is provided with a second limit groove 17-2 in a convex shape, and the second gear shaft 15-2 is inserted in the second limit groove 17-2. As the second limit groove 17-2 is provided in any one of adjusting grooves of the second adjusting groove 12-2, meanwhile the second gear shaft 15-2 is located in an upper portion of the second limit groove 17-2. Generally, the empty groove positions at the bottom ends of the first limit groove 17-1 and the second limit groove 17-2 are consistent with the empty groove positions communicating with the bottom ends of the first adjusting groove 12-1 and the second adjusting groove 12-2, therefore when the first support rod 9-1 and the first adjusting groove 12-1 as well as the second support rod 9-2 and the second adjusting groove 12-2 are stretching, the first gear shaft 15-1 and the second gear shaft 15-2 can be always located in the empty groove positions at the bottom ends of the first adjusting groove 12-1 and of the second adjusting groove 12-2, respectively, without contacted with the portion between two adjusting grooves of the first adjusting groove 12-1 and the second adjusting groove 12-2, such that the stretching can be achieved much more smoothly.

As shown in FIG. 7 and FIG. 8, in some embodiments, for the platform for conditioning meridian functions as mentioned above, the first angle adjusting mechanism 8-1 further includes a first spring 18-1 and the second angle adjusting mechanism 8-2 further includes a second spring 18-2.

The first spring 18-1 has one end connected to the front end of the first movable plate 14-1, and the other end thereof connected to a lower end of the first limit block 16-1 located behind the first limit groove 17-1.

The second spring 18-2 has one end connected to the front end of the second movable plate 14-2, and the other end thereof connected to a lower end of the second limit block 16-2 located behind the second limit groove 17-2.

Taking the structure of the first angle adjusting structure 8-1 as an embodiment, the first spring 18-1 is elongated during stretching by providing the first spring 18-1, furthermore, the first gear shaft 15-1 is enabled to be located at a lower-front end of the first limit groove 17-1. when the adjustment is ended, the first spring 18-1 restores an original length as no external force is exerted thereon, to push the first gear shaft 15-1 back to the upper end in a convex shape in the first limit groove 17-1, and further to be clamped in the first adjusting groove 12-1.

As shown in FIG. 1 and FIG. 2, in some embodiments, for the platform for conditioning meridian functions as mentioned above, the pedal includes: an upper housing 2, a lower housing 3 and a support plate 4 from top to bottom of the pedal. The upper housing 2 and the lower housing 3 are fixedly connected therebetween through a plurality of fixing screws 6; the lower housing 3 and the support plate 4 are fixedly connected therebetween through a plurality of fixing screws 6.

In some embodiments, for the platform for conditioning meridian functions as mentioned above, the pedal further includes: a skid-proof mat 1 which is provided on an upper surface of the pedal; a surface of the skid-proof mat 1 is provided with a plurality of skid-proof strips and a pedaling position indication area for indicating the user to a right pedaling position.

Figure 5:
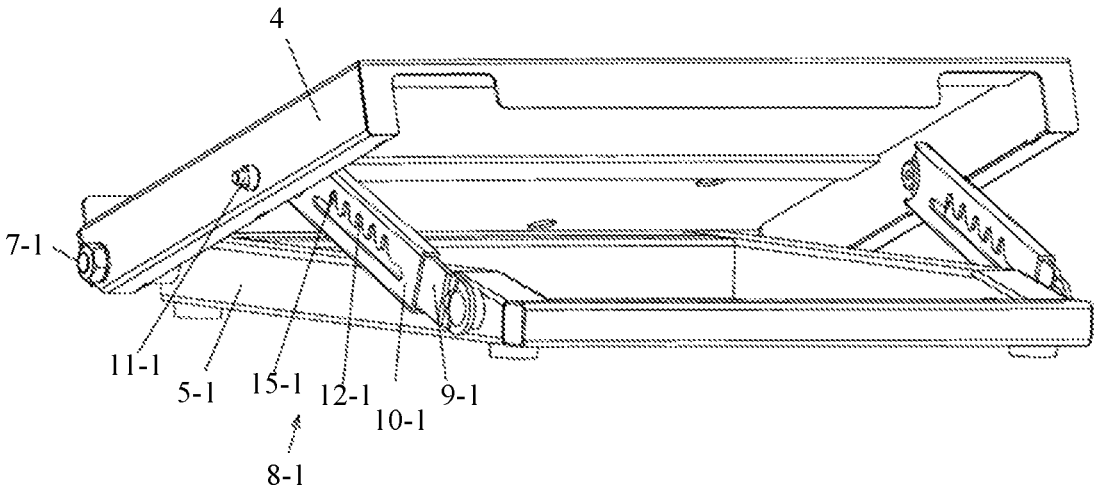
FIG. 5 is a partial structural of the front view of an embodiment of the present application which forms an angle of view.
Figure 6:
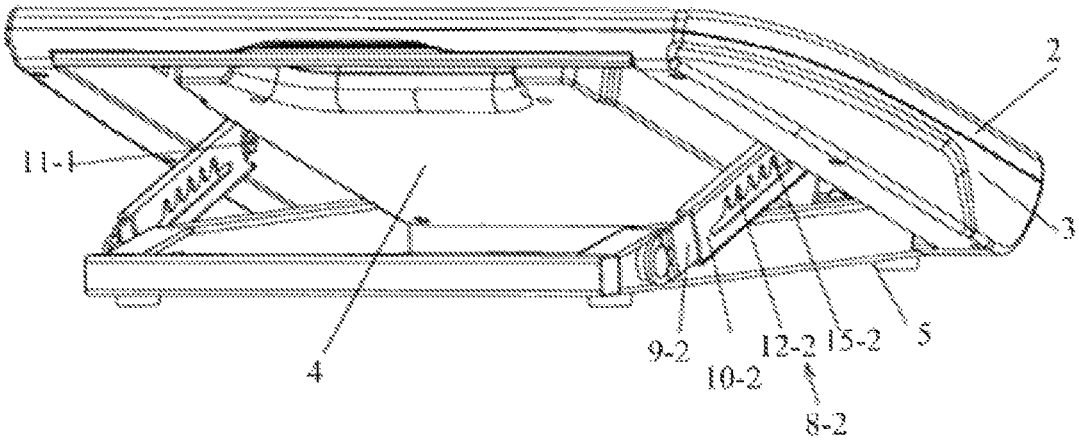
FIG. 6 is a partial structural of front view of an embodiment of the present application which forms another angle of view.

As shown in FIG. 5 and FIG. 6, in some embodiments, the platform for conditioning meridian functions as mentioned above which further includes a first bearing shaft 11-1, a second bearing shaft 11-2, a first rotating shaft 7-1 and a second rotating shaft 7-2.

One end of the first adjusting sleeve 10-1 is hinged to the left side of the bottom portion of the pedal through the first bearing shaft 11-1, and one end of the second adjusting sleeve 10-2 is hinged to the right side of the bottom portion of the pedal through the second bearing shaft 11-2.

The Left and right sides of the front end of the bottom portion of the pedal are hinged with the front end of the bracket 5 through the first rotating shaft 7-1 and the second rotating shaft 7-2, respectively.

While adjusting, the pedal is rotated clockwise or counterclockwise in relative to a rotating shaft 7, such that the support plate 4 is rotated to a position desired for the user in relative to the bracket 5, then the gear shaft 15 is slid into a pair of adjusting grooves corresponding to the position.

Figure 9:
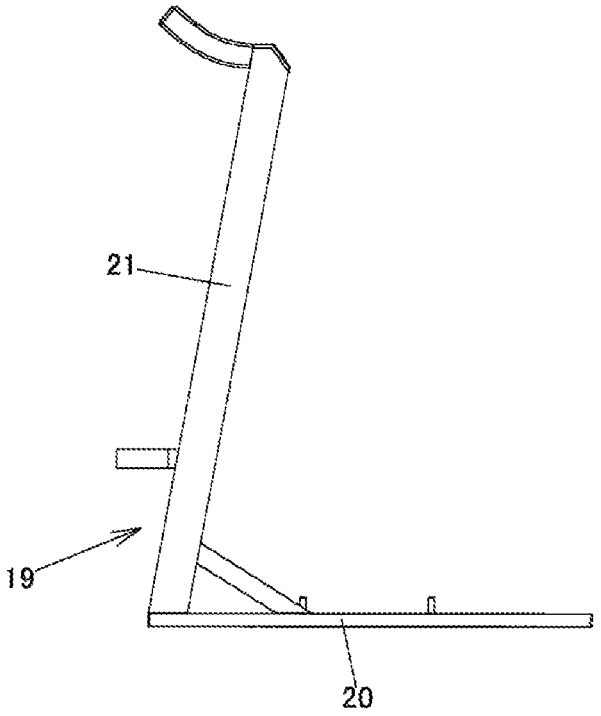
FIG. 9 is a structural front view of an assistant bracket of an embodiment of the present application.
Figure 10:
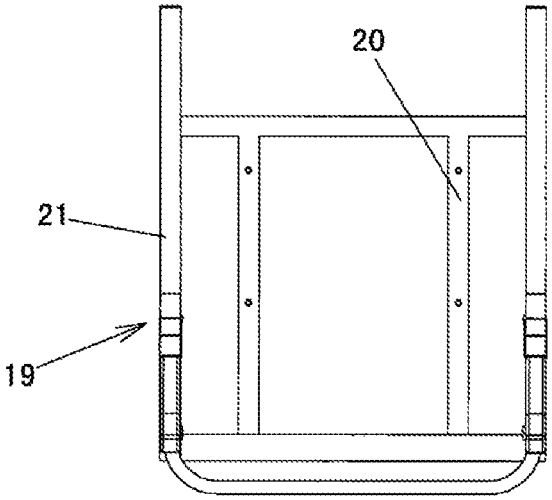
FIG. 10 is a right view of the assistant bracket of the embodiment of the present application.
Figure 11:
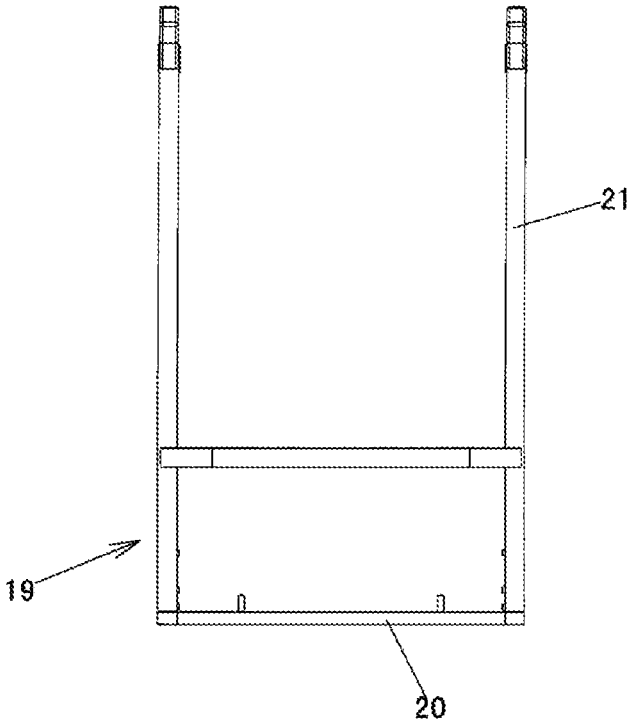
FIG. 11 is a top view of the assistant bracket of the embodiment of the present application.

As shown in FIG. 9, FIG. 10 and FIG. 11, in some embodiments, the platform for conditioning meridian functions as mentioned above which further includes: an assistant bracket mechanism 19 which includes: a bottom frame 20 and a handrail frame 21. The handrail frame 21 includes a vertical portion vertically provided on an upper surface of a front end of the bottom frame 20, and a handrail portion provided on a top end of the vertical portion and extended outwards in a horizontal direction.

In some embodiments, for the platform for conditioning meridian functions as mentioned above, the first adjusting groove 12-1 and the second adjusting groove 12-2 are symmetrically provided in five, respectively, and all of the adjusting grooves among the first adjusting groove 12-1 communicate with each other, and all of the adjusting grooves among the second adjusting groove 12-2 communicate with each other.

An angle between the angle adjusting mechanism 8 and the bracket 5 is in a range of 9 to 41.

The assistant bracket mechanism 19 is additionally provided for facilitating people with mobility problems, and mainly serving the external assistant support function.

As shown in FIG. 1, in some embodiments, for the platform for conditioning meridian functions as mentioned above, the one side of the upper housing 2 and lower housing 3 have correspondingly provided with a hollow notch 22 for hand holding.

The additionally provided hollow notch 22 can make more convenient in a process when the user carries the platform for conditioning meridian functions of the present application.

Obviously, a person skilled in the art should understand that various modules or various steps of the present invention mentioned above can be implemented by a general-purpose computing device, and they can be integrated on a single computing device, or distributed on a network formed by a plurality of computing devices, optionally, they can be implemented by program codes executable by a computing device, thus, they can be stored in a storage device and executed by a computing device, or they can be respectively fabricated into various integrated circuit modules, or a plurality of modules or steps thereof can be fabricated into a single integrated circuit module to be implemented. In this way, the present invention is not limited to combination of any hardware and software.

The above-mentioned are only for preferred embodiments of the present application, and not used to limit the present application. For a person skilled in the art, the present application may have various changes and variations. Any modifications, equivalent substitutions, improvements etc. within the spirit and principle of the present application shall all be included in the scope of protection of the present application.

What is claimed is:

1. A platform for conditioning meridian functions, comprising: a pedal and a bracket mechanism; the bracket mechanism comprising: a bracket and an angle adjusting mechanism; the angle adjusting mechanism comprising: a first angle adjusting mechanism and a second angle adjusting mechanism; the first angle adjusting mechanism comprising: a first support rod, a first adjusting sleeve, a first gear shaft and a first adjusting groove; the second angle adjusting mechanism comprising: a second support rod, a second adjusting sleeve, a second gear shaft and a second adjusting groove; the first adjusting groove and the second adjusting groove are symmetrically and respectively provided with a plurality of adjusting grooves;

a front end of the pedal and a front end of the bracket are hinged with each other;

the first adjusting groove is provided at one side of the first adjusting sleeve; one end of the first support rod is perpendicularly connected with the first gear shaft which can be inserted into the first adjusting groove, another end of the first support rod is hinged to a rear end of a left side of the bracket; one end of the first adjusting sleeve is hinged to a left side of a bottom portion of the pedal, and another end of the first adjusting sleeve is sleeved on the one end of the first support rod provided with the first gear shaft;

the second adjusting groove is provided at one side of the second adjusting sleeve; one end of the second support rod is perpendicularly connected with the second gear shaft which can be inserted into the second adjusting groove, another end of the second support rod is hinged to a rear end of a right side of the bracket; one end of the second adjusting sleeve is hinged to a right side of the bottom portion of the pedal, and another end of the second adjusting sleeve on the one end of the second support rod provided with the second gear shaft, the first angle adjusting mechanism further comprises: a first notch and a first movable plate provided in one end of the first gear shaft which is provided in the first support rod; the second angle adjusting mechanism further comprises: a second notch and a second movable plate provided in one end of the second gear shaft which is provided in the second support rod;

the first movable plate is slidingly provided inside the first adjusting sleeve; the first movable plate is a U-shape movable plate, one end of the first movable plate is clamped with the first notch, and another end of the first movable plate is provided with the first gear shaft;

the second movable plate is slidingly provided inside the second adjusting sleeve; the second movable plate is a U-shape movable plate, one end of the second movable plate is clamped with the second notch, and another end of the second movable plate is provided with the second gear shaft.

2. The platform for conditioning meridian functions of claim 1, wherein the bracket mechanism comprises at least two angle adjusting mechanisms.

3. The platform for conditioning meridian functions of claim 2, the at least two angle adjusting mechanisms respectively further comprise: a limit block slidingly provided inside the adjusting sleeve;

the limit block is provided with a limit groove with a convex shape, the gear shaft is inserted in the limit groove, the gear shaft is located in an upper portion of the limit groove, and the limit groove is provided in any one of a plurality of secondary adjusting grooves, wherein the plurality of secondary adjusting grooves are located within the adjusting groove.

4. The platform for conditioning meridian functions of claim 2, an angle between one of the angle adjusting mechanisms and the bracket is in a range of 9 to 41 degrees.

5. The platform for conditioning meridian functions of claim 1, the first angle adjusting mechanism further comprises: a first limit block slidingly provided inside the first adjusting sleeve; the second angle adjusting mechanism further comprises: a second limit block slidingly provided inside the second adjusting sleeve;

the first limit block is provided with a first limit groove with a convex shape, the first gear shaft is inserted in the first limit groove, the first gear shaft is located in an upper portion of the first limit groove while the first limit groove is provided in any one of the plurality of adjusting grooves of the first adjusting groove;

the second limit block is provided with a second limit groove with a convex shape, the second gear shaft is inserted in the second limit groove, the second gear shaft is located in an upper portion of the second limit groove while the second limit groove is provided in any one of the plurality of adjusting grooves of the second adjusting groove.

6. The platform for conditioning meridian functions of claim 5, the first angle adjusting mechanism further comprises a first spring; the second angle adjusting mechanism further comprises a second spring;

one end of the first spring connected to a front end of the first movable plate, and another end of the first spring connected to a lower end of the first limit block located behind the first limit groove;

one end of the second spring connected to a front end of the second movable plate, and another end of the second spring connected to a lower end of the second limit block located behind the second limit groove.

7. The platform for conditioning meridian functions of claim 1, the pedal comprises: an upper housing, a lower housing and a support plate provided in order from top to bottom; the upper housing and the lower housing are fixedly connected therebetween through a first plurality of fixing screws; the lower housing and the support plate are fixedly connected therebetween through a second plurality of fixing screws.

8. The platform for conditioning meridian functions of claim 7, one side of the upper housing and the lower housing correspondingly provided with a hollow notch configured to be held by a hand of a user.

9. The platform for conditioning meridian functions of claim 1, the pedal further comprises: a skid-proof mat; the skid-proof mat is provided on an upper surface of the pedal; a surface of the skid-proof mat is provided with a plurality of skid-proof strips and a pedaling position indication area for indicating a user to a correct pedaling position.

10. The platform for conditioning meridian functions of claim 1, further comprising: a first bearing shaft, a second bearing shaft, a first rotating shaft and a second rotating shaft;

the one end of the first adjusting sleeve being hinged to the left side of the bottom portion of the pedal through the first bearing shaft, and the one end of the second adjusting sleeve being hinged to the right side of the bottom portion of the pedal through the second bearing shaft;

the left and right sides of the bottom portion of the pedal being hinged, at the front end of the pedal, with the front end of the bracket through the first rotating shaft and the second rotating shaft, respectively.

11. The platform for conditioning meridian functions of claim 1, further comprising an assistant bracket mechanism; the assistant bracket mechanism comprising: a bottom frame and a handrail frame; the handrail frame comprising a vertical portion vertically provided on an upper surface of a front end of the bottom frame, and a handrail portion provided on a top end of the vertical portion and extended outwards in a horizontal direction.

12. The platform for conditioning meridian functions of claim 1, wherein the plurality of adjusting grooves comprises five adjusting grooves, wherein the first adjusting groove and the second adjusting groove are symmetrically and respectively provided with the five adjusting grooves, and the five adjusting grooves of the first adjusting groove communicate with each other, and the five adjusting grooves of the second adjusting groove communicate with each other;

an angle between the angle adjusting mechanism and the bracket is in a range of 9 to 41 degrees.

* * * * *